US006183270B1

(12) United States Patent
Huang et al.

(10) Patent No.: US 6,183,270 B1
(45) Date of Patent: Feb. 6, 2001

(54) ELECTRICAL CONNECTOR

(75) Inventors: Li-Pei Huang; Chien-Kuo Liao, both of Tu-Chen (TW); Wayne Huang, Alhambra, CA (US)

(73) Assignee: Hon Hai Precision Ind. Co., Ltd., Taipei Hsien (TW)

( * ) Notice: Under 35 U.S.C. 154(b), the term of this patent shall be extended for 0 days.

(21) Appl. No.: 09/247,664

(22) Filed: Feb. 9, 1999

(30) Foreign Application Priority Data

Feb. 9, 1998 (TW) ..... 87201923

(51) Int. Cl.[7] ..... H01R 1/00
(52) U.S. Cl. ..... 439/79; 439/541.5
(58) Field of Search ..... 439/79, 80, 541.5, 439/82

(56) References Cited

U.S. PATENT DOCUMENTS 5,336,109 * 8/1994 Hillbish et al. ..... 439/541.5
5,591,036 * 1/1997 Doi et al. ..... 439/79
5,601,438 * 2/1997 Ho et al. ..... 439/541.5
5,879,171 * 3/1999 Wu ..... 439/79
5,957,705 * 9/1999 David et al. ..... 439/79

* cited by examiner

*Primary Examiner*—T. C. Patel
(74) *Attorney, Agent, or Firm*—Wei Te Chung

(57) ABSTRACT

An electrical connector includes an insulative connector body with two arms extending from opposite sides thereof. A plurality of rows of pin receiving channels are defined in the connector body each receiving an L-shaped terminal pin having a horizontal portion and a vertical portion. The horizontal portion of each of the terminal pins is partially received in the corresponding pin receiving channel and partially exposed. A pin holding member is arranged between and mounted to the arms of the connector body and defines slots for receiving and retaining the exposed portions of the horizontal portions of the terminal pins therein thereby protecting the exposed portions against deformation when mounting the connector to a circuit board.

15 Claims, 6 Drawing Sheets

ELECTRICAL CONNECTOR

BACKGROUND OF THE INVENTION

1. Field of the Invention

The present invention generally relates to an electrical connector and particularly to an electrical connector having a pin holding member which secures terminal pins in position and protects the terminal pins against deformation when mounting the connector to a circuit board thereby facilitating assembly.

2. The Prior Art

Electrical connectors having a plurality of rows of terminal pins are now widely used. To minimize the size of the connectors, the terminal pins of the connectors are usually densely arranged whereby inadvertent contact between adjacent pins frequently occurs. To overcome such a problem, a pin holding member is provided which effectively retains the pins in position and spaces the pins from each other. Usually, the terminal pins of the connector are formed to have an L shape, with a horizontal section received in an associated channel defined in the connector and a vertical section extending from the horizontal section to engage with a the circuit board on which the connector is mounted. A portion of the horizontal section is exposed outside the channel from which the vertical section extends. Conventionally, the pin holding member is arranged to retain and prevent the vertical sections of the terminal pins from contacting each other.

However, for a connector having a plurality of aligned and stacked rows of terminal pins, the exposed portions of the horizontal sections of the terminal pins of the upper rows are usually longer than those of the lower rows in order to provide a space for accommodating the lower rows. The longer the exposed portion of the horizontal section of the terminal pin, the greater the chances of deformation resulting when mounting the connector to the circuit board since a vertical force is usually exerted on the exposed portions. The adverse effects of such an assembly technique may not be overcome by the conventional pin holding member.

Thus, it is desirable to have an electrical connector structure incorporating therein a pin holding device which overcomes the problem discussed above.

SUMMARY OF THE INVENTION

Accordingly, an object of the present invention is to provide an electrical connector comprising a pin holding device for retaining the horizontal sections of pins in position.

To achieve the above object, in accordance with the present invention, there is provided an electrical connector comprising an insulative connector body with two arms extending from opposite sides thereof. A plurality of rows of pin receiving channels are defined in the connector body each receiving an L-shaped terminal pin having a horizontal portion and a vertical portion. The horizontal portion of each of the terminal pins is partially received in the corresponding pin receiving channel and partially exposed. A pin holding member is arranged between and mounted to the arms of the connector body and defines slots for receiving and retaining the exposed portions of the horizontal portions of the terminal pins therein for protecting the exposed portions against deformation when mounting the connector to a circuit board.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENTS

Figure 1:
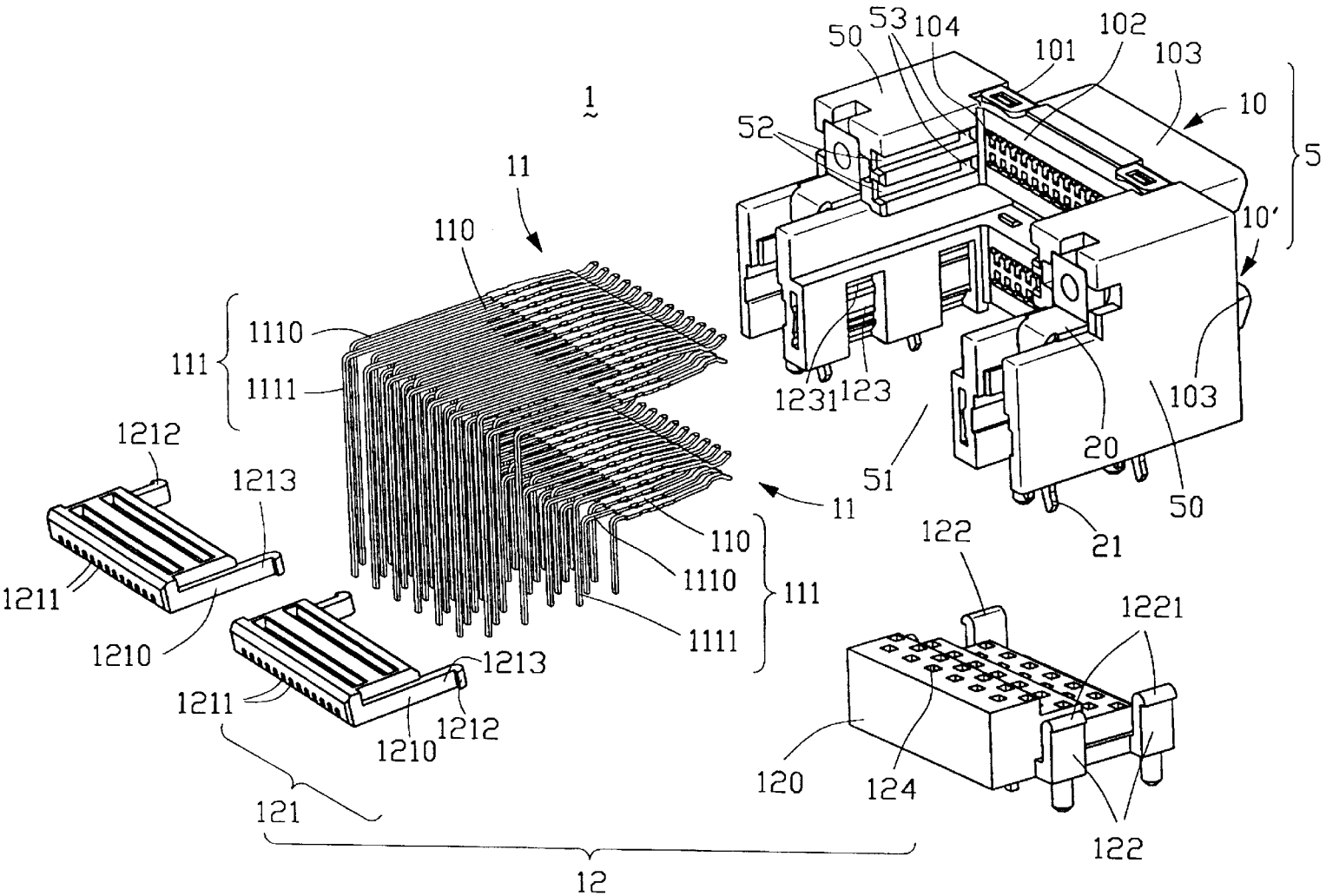
FIG. 1 is an exploded view of an electrical connector constructed in accordance with the present invention.

With reference to the drawings and in particular to FIG. 1, wherein an electrical connector constructed in accordance with the present invention, generally designated by reference numeral 1, is shown, the connector 1 of the present invention comprises an insulative connector body 5 having a first portion 10 and a second portion 10' stacked on each other in a first direction (vertical direction). Each of the first and second portions 10, 10' of the connector 1 has an outer side face 101 from which a projection 103 extends in a second direction (horizontal direction), which is substantially normal to the first direction, and an inner side face 102. A plurality of channels 104 are defined through the projection 103 and exposed to the inner side face 102 for each receiving a terminal pin 11 therein. The projection 103 is to mate with a counterpart portion of an associated connector (not shown).

The channels 104 of each of the first and second portions 10, 10' are arranged in a plurality of rows spaced in the first direction, such as two rows in the embodiment illustrated, and the channels 104 of each row are spaced from and aligned with each other in a third direction which is substantially normal to the first and second directions. Thus, there are four rows of channels 104 in the embodiment illustrated and the four rows are arranged to be vertically stacked above each other.

Each of the terminal pins 11 has a first section 110 received in the respective channel 104 and a second section 111. The second section 111 of the terminal pin 11 has a horizontal segment 1110 of a predetermined length extending from the first section 110 in the horizontal direction and a vertical segment 1111 which is substantially normal to and extends from the horizontal segment 1110 thereby defining an L-shaped configuration. The length of the horizontal segment 1110 of the second section of the terminal pins 11 is different from row to row whereby the terminal pins 11 in different rows do not interfere with each other.

The connector body 5 has two arms 50 extending from two opposite sides thereof thereby defining a space 51 therebetween. Each of the arms 50 has circuit board engaging means 20 having a free end 21 engageable with a circuit board 30 (see FIGS. 4A and 4B) for mounting the connector 1 to the circuit board 30. The free end 21 of the circuit board engaging means 20 may comprise a pair of resilient legs spaced from each other for elastic deformation during insertion through corresponding apertures 31 of the circuit board 30. This is well known to those skilled in the art whereby a further detailed description thereof is omitted herein. Further, it is apparent to those skilled in the art to use other means to replace the circuit board engaging means 20 shown in the drawings for mounting the connector 1 to the circuit board 30.

In accordance with the present invention, pin holding means 12 is provided to retain the terminal pins 11 in position. The pin holding means 12 comprises a first pin holding member 120 dimensioned to fit into the space 51 defined between the two arms 50 of the connector 1.

The first pin holding member 120 defines a plurality of bores 124 arranged in rows corresponding to the rows of the channels 104 of the connector body 5 and spaced from each other. The bores 124 receive the vertical segments 1111 of the second section 111 of the terminal pins 11 thereby retaining the vertical segments 1111 of the terminal pins 11 in position.

The first pin holding member 120 forms a plurality of resilient arms 122 each having a barbed end 1221. The resilient arms 122 of the first pin holding member 120 are receivable in corresponding slots 123 provided on inside surfaces of the two arms 50 of the connector body 5. Each slot 123 has at least one shoulder 1231 formed therein which engages with the barbed end 1221 of the respective resilient arm 122 of the first pin holding member 120 thereby retaining the first pin holding member 120 in the space defined between the arms 50 of the connector body 5.

Preferably, each of the slots 123 forms two or more shoulders 1231 with which the barbed end 1221 of the respective resilient arm 122 of the first pin holding member 120 may be selectively engageable.

In accordance with the present invention, the pin holding means 12 further comprises at least one second pin holding member 121. In the embodiment illustrated, two such second pin holding members 121 are provided and are respectively associated with the two rows of channels of the upper (first) portion 10 of the connector 1.

Figure 2:
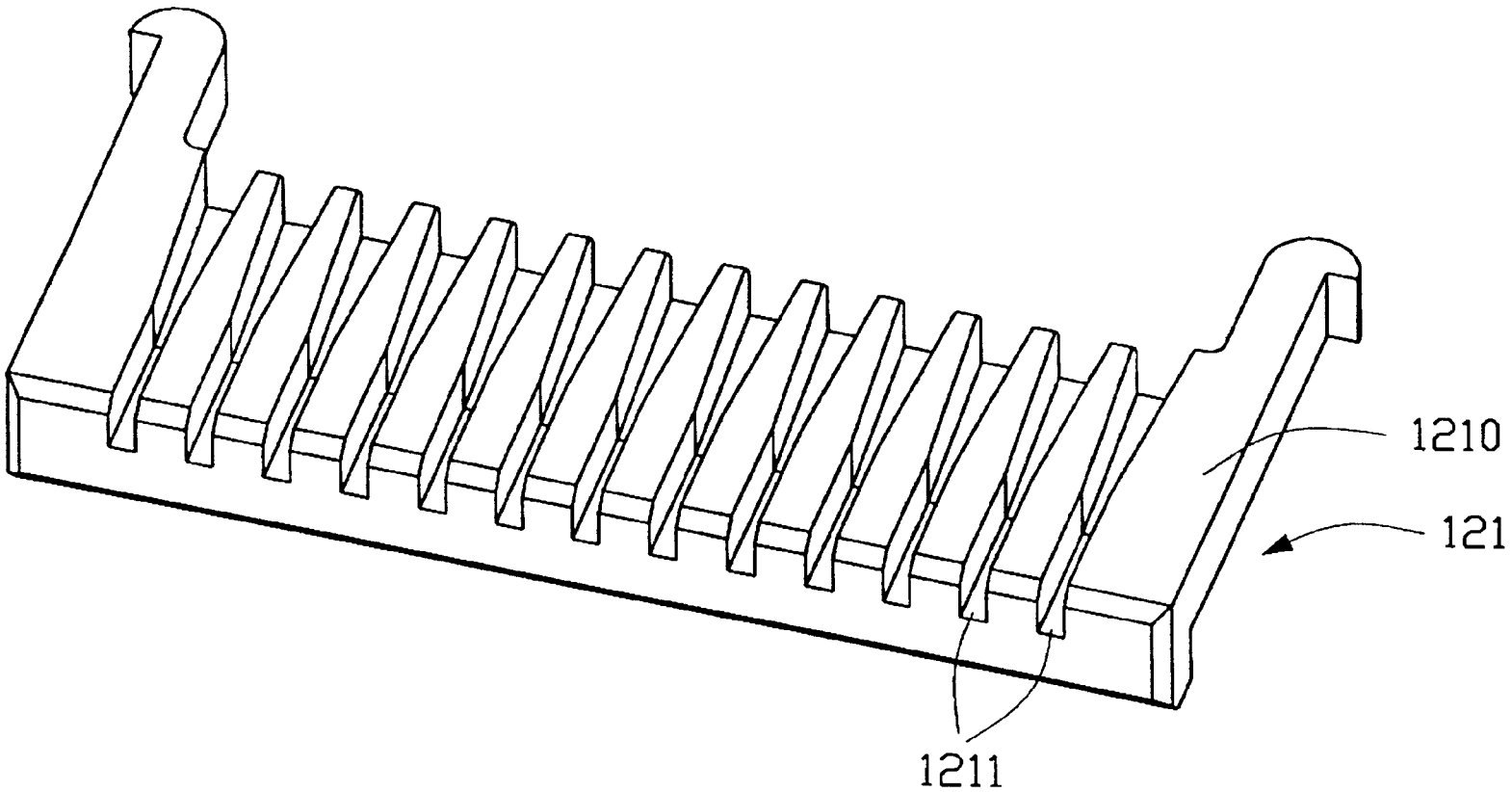
FIG. 2 is a bottom perspective view showing of a pin holding member to be incorporated in the connector of the present invention.

Referring also to FIG. 2, the second holding members 121 are received between the two arms 50 of the connector body 5 and each defines a plurality of spaced slots 1211 in the second direction for receiving the horizontal segment 1110 of the second section 111 of the corresponding terminal pin 11. Thus, the horizontal segments 1110 of the second sections 111 of the terminal pins 11 are retained in position. It is noted that to allow the vertical segment 1111 to pass therethrough during assembling the second holding member 121 to the connector body 5, such slots 1211 extend through the undersurface of the pin holding member 121 as shown in FIG. 2.

To mount the second pin holding members 121 to the connector 1, the arms 50 of the connector body 5 define a pair of opposite slots 52 associated with each of the second pin holding members 121. Each second pin holding member 121 forms a pair of flanges 1210 on opposite sides thereof to be received in the respective slots 52 thereby retaining the second pin holding member 121 between the two arms 50 of the connector body 5.

The slots 52 for holding the second pin holding members 121 are formed whereby the second pin holding members 121 are located above the associated terminal pins 11 thereby protecting the horizontal segments 1110 of the terminal pins 11 from deformation due to a vertical force being applied thereon. Such a force generally occurs when mounting the connector 1 to the circuit board 30 wherein the vertical segments 1111 of the terminal pins 11 are inserted into the corresponding apertures 31 of the circuit board 30 which induces a vertical reaction force in the terminal pins 11.

Preferably, each of the slots 52 defined in the inside surfaces of the arms 50 of the connector body 5 for retaining the second pin holding members 121 defines a recess 53 on an inner end thereof and the respective flange 1210 of the second pin holding member 120 is provided with an extension 1213 having a barbed end 1212 for engaging the recess 53 thereby retaining the second pin holding member 120 in the slots 52.

Figure 3A:
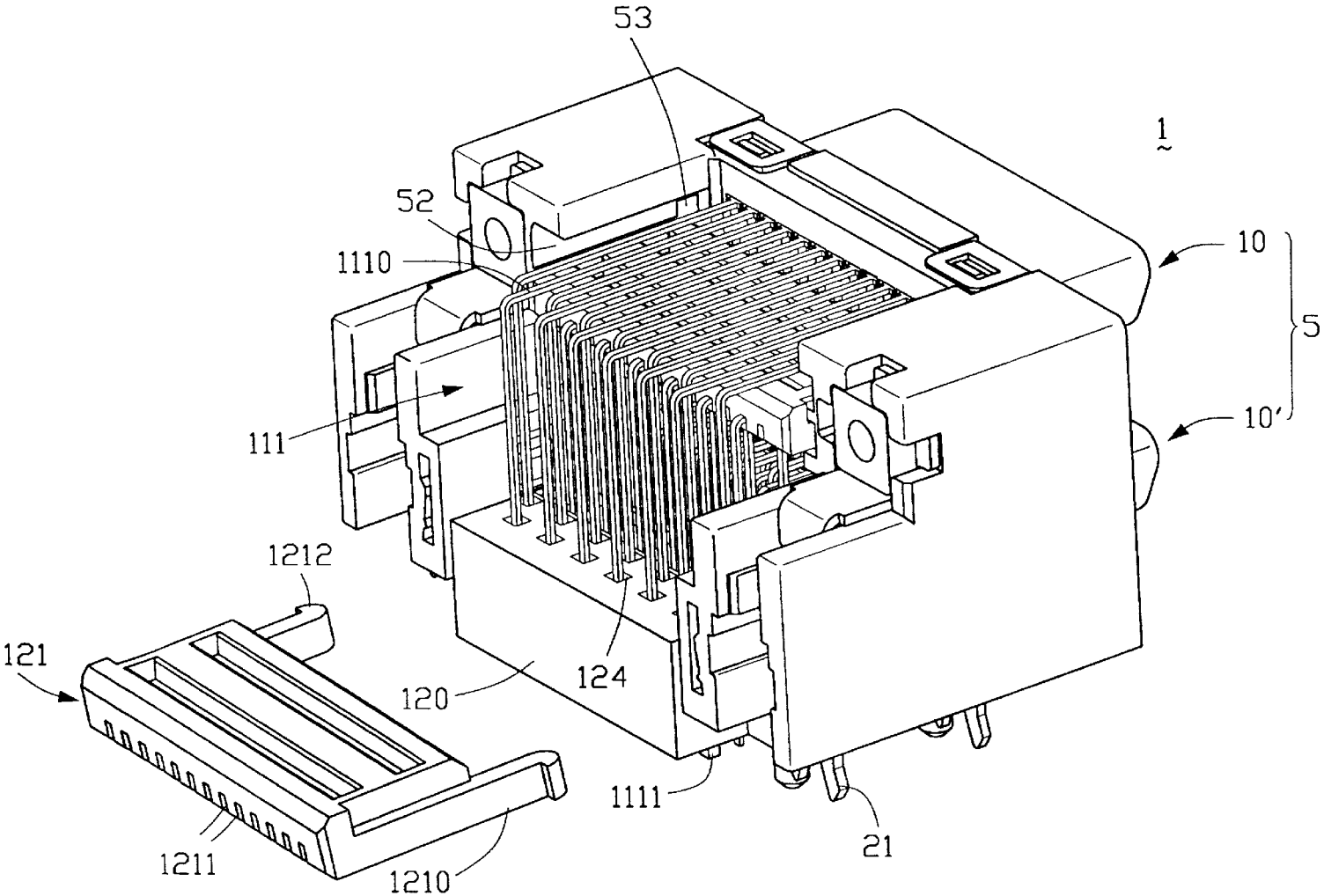
FIGS. 3A and 3B are perspective views showing different steps of assembling the connector of the present invention.
Figure 3B:
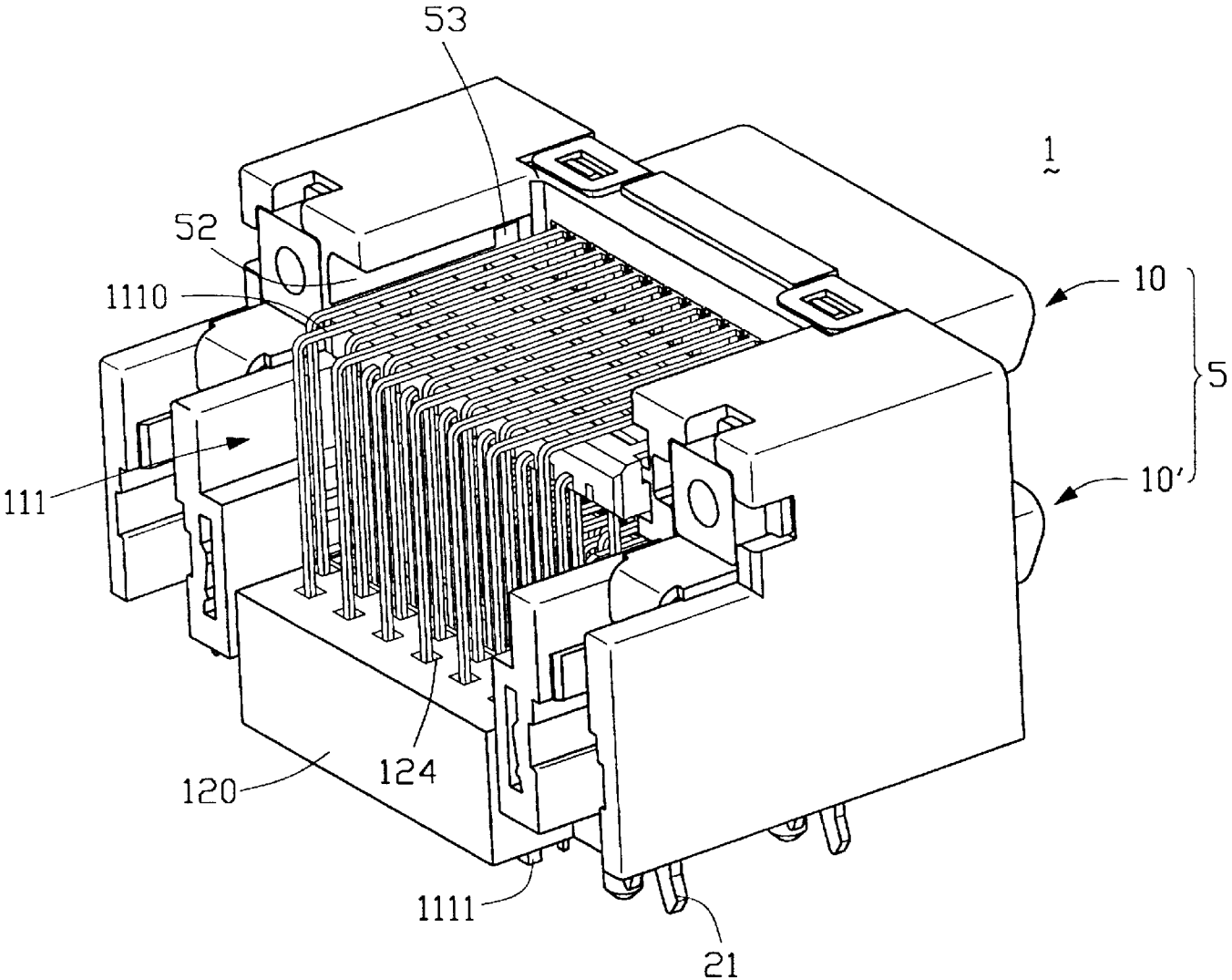

FIGS. 3A and 3B show the steps of mounting the second pin holding members 121 to the connector body 5. As shown in FIG. 3A, one of the second pin holding members 121 is mounted to the connector body 5 to retain the lower row terminal pins 11 of the first portion 10. Then the upper row terminal pins 11 of the first portion 10 are bent to form the L-shaped configuration. Thereafter, as shown in FIG. 3B, the other one of the second pin holding members 121 is mounted to the connector body 5 to retain the upper row terminal pins 11 in position.

Figure 4A:
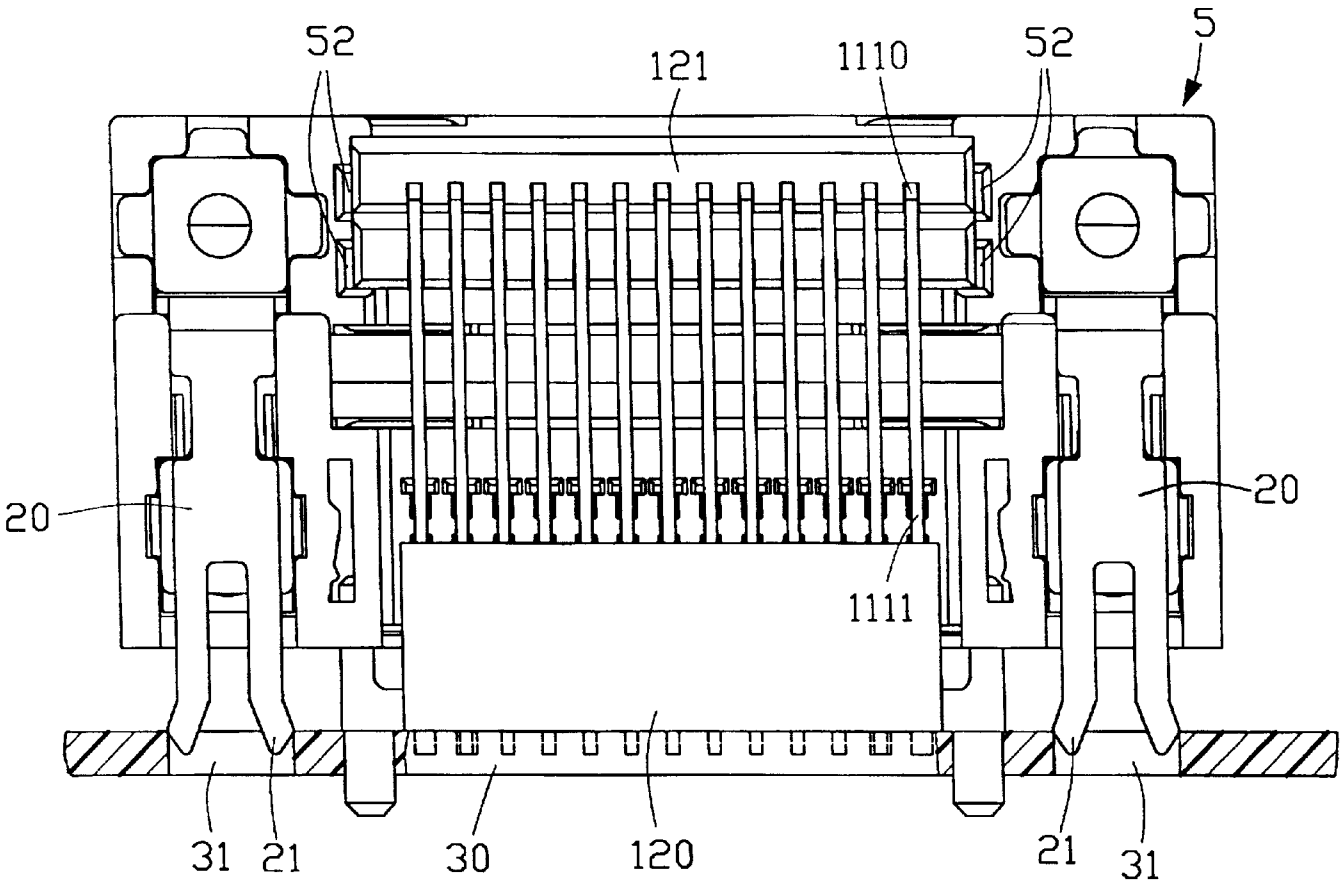
FIGS. 4A and 4B are side elevational views showing the steps of mounting the connector of the present invention to a circuit board.
Figure 4B:
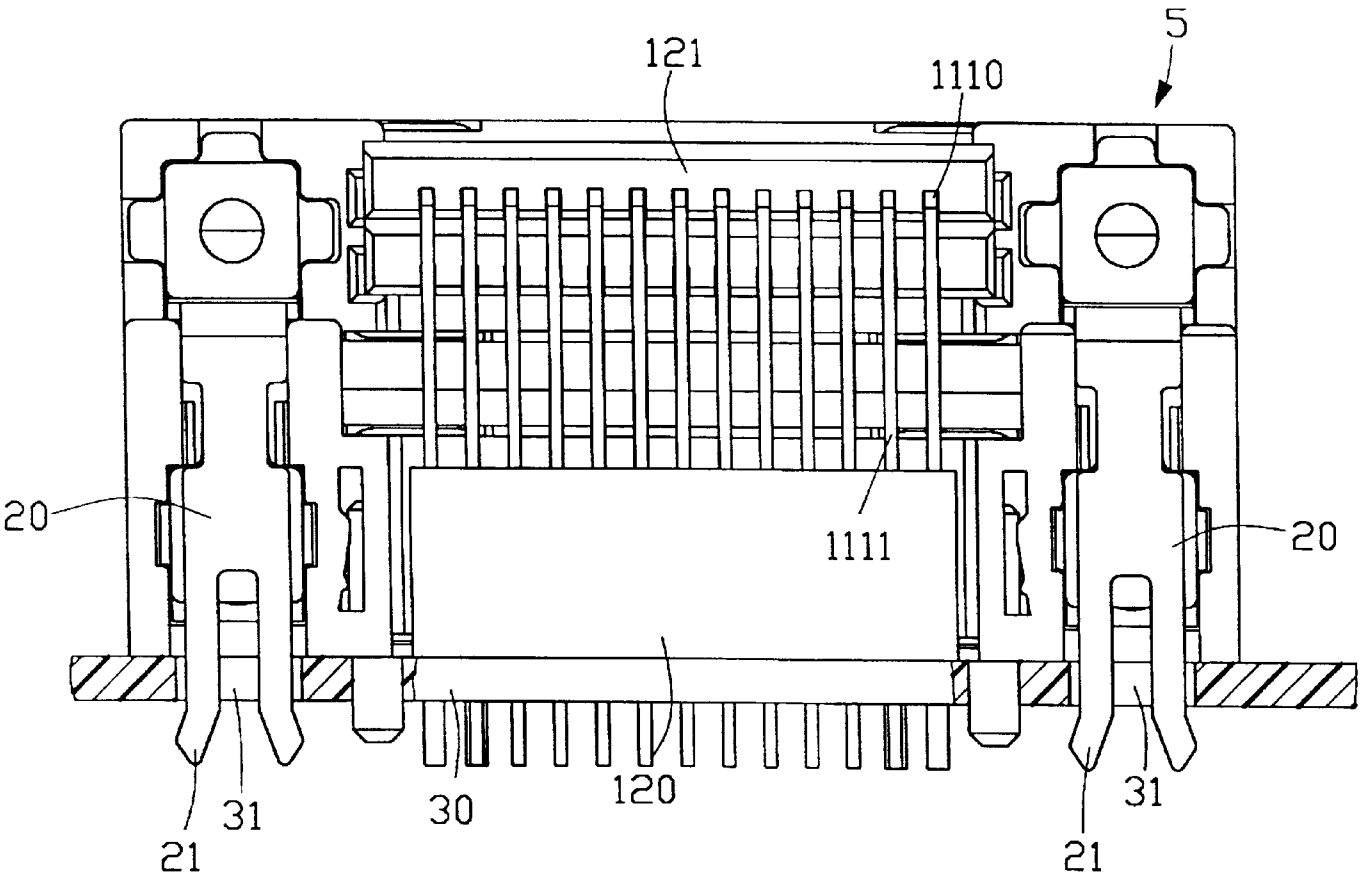

With reference to FIGS. 4A and 4B, when assembling the connector 1, the first pin holding member 120 is fit between the arms 50 of the connector body 5 at such a position where the barbed end 1221 of the resilient arms 122 engage with the lower inside shoulders 1231 of the slots 123 and free ends of the vertical segments 1111 of the terminal pins 11 extending beyond the first pin holding member 120. When mounting the assembled connector 1 to the circuit board 30, the connector 1 is positioned at a predetermined location of the circuit board 30 and then depressed which causes the circuit board engaging means 20 to engage with the circuit board 30 and the reaction force from the circuit board 30 on the first pin holding member 120 drives the first pin holding member 120 further between the arms 50 of the connector body 5 whereby the barbed ends 1221 of the resilient arms 122 of the first pin holding member 120 engage with the upper inside shoulders 1231 of the slots 123 of the arms 50 of the connector body 5.

During this process, the second pin holding members 121 effectively prevents the horizontal segments 1110 of the second sections 111 of the terminal pins 11 from becoming displaced and deformed thereby facilitating engagement of the free ends of the terminal pins 11 with the circuit board 30.

It should be noted that, only the terminal pins 11 of the first (upper) portion 10 are required to cooperate with the corresponding second pin holding member 121 for preventing their horizontal segments 1110 thereof from upward moving because of relatively longer vertical segments 1111 thereof in comparison with those of the second (lower) portion 10' wherein such relatively longer vertical segments 1111 of the upper portion 10 may easier lose the true positions of their free ends thereof with regard to the circuit board 30 and displaced upward during engagement with the circuit board 30, in comparison with the relatively shorter vertical segments 1111 of the lower portion 10'. Additionally, the invention specifically uses the two separate upper and lower second pin holding members 121 which are respectively installed to the connector body 50 at two different levels and at two different sequential stages for respectively retainably controlling the upper row and lower row terminal pins 11 in the upper portion 10 in position.

Although the present invention has been described with reference to a preferred embodiment, it is apparent to those skilled in the art that a variety of modifications and changes may be made without departing from the scope of the present invention which is intended to be defined by the appended claims.

What is claimed is:

1. An electrical connector comprising:

an insulative connector body comprising an upper portion stacked on a lower portion, each portion defining two rows of pin receiving channels therethrough, the rows being horizontally arranged above each other;

a plurality of terminal pins arranged in rows, each having a first section extending in a predetermined direction and received in a corresponding pin receiving channel and a second section comprising a horizontal segment extending from the first section in the predetermined direction and a second segment extending from the horizontal segment in another direction that is not parallel to the predetermined direction, the horizontal segments of the terminal pins of the upper portion having a length greater than the length of the horizontal segments of the terminal pins of the lower portion; and two pin holding members mounted to the connector body and corresponding to the terminal pins of the two rows of the upper portion, each pin holding member defining a plurality of slots in the predetermined direction for receiving the horizontal segments of the second sections of the terminal pins of the upper portion, thereby retaining the terminal pins of the upper portion in position.

2. The electrical connector as claimed in claim 1, wherein the connector body forms a pair of arms extending from opposite sides thereof, each arm defining at least one guide slot therein and wherein each pin holding member is dimensioned to be receivable between the two arms, the pin holding member forming a pair of side flanges on two opposite sides thereof to be receivable in the guide slots for mounting the pin holding member to the connector body.

3. The electrical connector as claimed in claim 1, further comprising a further pin holding member mounted to the connector body and defining a plurality of bores for receiving the corresponding second segments of the terminal pins therein.

4. The electrical connector as claimed in claim 3, wherein the connector body forms a pair of arms extending from opposite sides thereof, each arm defining slots therein, each slot having at least one inside barb formed therein, and wherein the further pin holding member comprises a plurality of resilient arms to be respectively received in the slots of the arms of the connector body, each of the resilient arms of the further pin holding member having a barbed end engageable with the inside barb of the corresponding slot of the arms of the connector body thereby mounting the further pin holding member to the connector body.

5. The electrical connector as claimed in claim 4, wherein each of the slots of the arms of the connector body has two inside barbs formed therein and spaced from each other whereby the barbed end of the corresponding resilient arm of the further pin holding member is selectively engageable with one of the inside barbs.

6. The electrical connector as claimed in claim 1 further comprising circuit board engaging means adapted to mount the connector to a circuit board whereby a free end of the second segment of each of the terminal pins engages with a circuit of the circuit board and wherein the pin holding member is mounted to the connector body such that at least a portion of the pin holding member is located opposite the second segments of the terminal pins with respect to the horizontal segments thereby retaining the horizontal segments against a force exerted on the second segments when mounting the connector to the circuit board.

7. The electrical connector as claimed in claim 1, wherein the pin holding member is mounted to the connector body for retaining the horizontal segments of the terminal pins in position and for protecting the horizontal segments against deformation.

8. The electrical connector as claimed in claim 1, wherein the connector body forms a pair of arms extending from opposite sides thereof, each arm defining two guide slots therein and wherein the pin holding members are dimensioned to be receivable between the arms, each of the pin holding members forming a pair of side flanges on opposite sides thereof to be receivable in the guide slots for mounting the pin holding member to the connector body.

9. The electrical connector as claimed in claim 1 further comprising a further pin holding member mounted to the connector body and defining a plurality of bores for receiving the corresponding second segments of the terminal pins therein.

10. The electrical connector as claimed in claim 9, wherein the connector body forms a pair of arms extending from opposite sides thereof, each arm defining slots therein, each slot having at least one inside barb formed therein, and wherein the further pin holding member comprises a plurality of resilient arms to be respectively received in the slots of the arms of the connector body, each of the resilient arms of the further pin holding member having a barbed end engageable with the inside barb of the corresponding slot of the arms of the connector body thereby mounting the further pin holding member to the connector body.

11. The electrical connector as claimed in claim 10, wherein each of the slots of the arms of the connector body has two inside barbs formed therein and spaced from each other whereby the barbed end of the corresponding resilient arm of the further pin holding member is selectively engageable with one of the inside barbs.

12. The electrical connector as claimed in claim 1 further comprising circuit board engaging means adapted to mount the connector to a circuit board whereby a free end of the second segment of each of the terminal pins engages a circuit of the circuit board and wherein each of the pin holding members is mounted to the connector body such that at least a portion of the pin holding member is located opposite the second segments of the terminal pins of the corresponding row with respect to the horizontal segments thereby retaining the horizontal segments against a force exerted on the second segments when mounting the connector to the circuit board.

13. The electrical connector as claimed in claim 1, wherein the pin holding members are mounted to the connector body for retaining the horizontal segments of the terminal pins of the respective rows in position and for protecting the horizontal segments against deformation.

14. A connector comprising:

a connector body defining an upper portion and a lower portion, said upper portion defining an upper row and a lower row of pin receiving channels therein;

a first group of terminal pins received within the corresponding pin receiving channels of the lower row;

a lower pin holding member attached to the connector body and engaged with the first group of terminal pins;

a second group of terminal pins receiving within the corresponding pin receiving channels of the upper row; and an upper pin holding member attached to the connector body and engaged with the second group of terminal pins; wherein said lower pin holding member is positioned below the upper pin holding member and between the first group of terminal pins and the second group of terminal pins.

15. The connector as claimed in claim 14, wherein the second group of terminal pins includes vertical segments positioned behind the lower pin holding member.

* * * * *